US006639989B1

(12) United States Patent
Zacharov et al.

(10) Patent No.: US 6,639,989 B1
(45) Date of Patent: Oct. 28, 2003

(54) METHOD FOR LOUDNESS CALIBRATION OF A MULTICHANNEL SOUND SYSTEMS AND A MULTICHANNEL SOUND SYSTEM

(75) Inventors: Nick Zacharov, Tampere (FI); Pekka Suokuisma, Korkeakoski (FI)

(73) Assignee: Nokia Display Products Oy, Salo (FI)

( * ) Notice: Subject to any disclaimer, the term of this patent is extended or adjusted under 35 U.S.C. 154(b) by 0 days.

(21) Appl. No.: 09/400,770

(22) Filed: Sep. 22, 1999

(30) Foreign Application Priority Data

Sep. 25, 1998 (FI) ..... 982067

(51) Int. Cl.[7] ..... H04R 5/02

(52) U.S. Cl. ..... 381/303; 381/307; 381/58; 381/103

(58) Field of Search ..... 381/59, 96, 103, 381/58, 98, 56, 104, 107, 99, 101, 102, 303, 307

(56) References Cited

U.S. PATENT DOCUMENTS 3,182,271 A * 5/1965 Aiken ..... 381/102
3,865,982 A * 2/1975 Feldman et al.
4,118,601 A * 10/1978 Yeap
4,694,498 A * 9/1987 Suzuki et al.
4,809,338 A * 2/1989 House ..... 381/103
5,377,274 A * 12/1994 Meyer et al.
5,386,478 A * 1/1995 Plunkett ..... 381/103
5,555,306 A 9/1996 Gerzon
5,666,424 A * 9/1997 Fosgate et al.
5,745,583 A * 4/1998 Koizumi et al.
5,815,580 A * 9/1998 Craven et al.
6,118,875 A * 9/2000 Moller et al.
6,118,880 A * 9/2000 Kokkosoulis et al. ..... 381/303
6,347,148 B1 * 2/2002 Brennan et al. ..... 381/312

FOREIGN PATENT DOCUMENTS

WO 9740642 10/1997
WO 9846044 10/1998

OTHER PUBLICATIONS

Treamine, Howard M., Audio Cyclopedia, 2nd Edition 1973, Howard W. Sames & Co., Inc., p. 248.*

* cited by examiner

*Primary Examiner*—Forester W. Isen
*Assistant Examiner*—Brian Pendleton
(74) *Attorney, Agent, or Firm*—Ware, Fressola, Van Der Sluys & Adolphson LLP

(57) ABSTRACT

A method and a system for loudness calibration of a multichannel sound systems, wherein the test signal is psychoacoustically shaped. The psychoacoustically shaped test signal is preferably a pseudorandom test signal suitable for both automatic and subjective loudness calibration. Further, the psychoacoustically shaped test signal preferably has essentially constant specific loudness on the frequency range essential for aural perception.

17 Claims, 5 Drawing Sheets

METHOD FOR LOUDNESS CALIBRATION OF A MULTICHANNEL SOUND SYSTEMS AND A MULTICHANNEL SOUND SYSTEM

BACKGROUND OF THE INVENTION

1. Field of the Invention

The present invention relates to a method for loudness calibration of a multi-channel sound systems: The present invention also relates to a multichannel sound system.

2. Description of Related Art

The following terminology is used in the document. The reproduction level of a sound system is controlled by volume control, which changes the channel gains equally. The channel gain is a channel specific control with respect to initial level to be used for compensating various differences between loud-speakers e.g. in sensitivity. The level calibration is used to adjust the channel gains to give equal physical measure at the listening position using a test signal. The loudness calibration is used to adjust the channel gains to give equal loudness at the listening position using test signal. The loudness is an auditory sensation and as such it can not be directly measured. It depends on acoustical intensity, frequency, duration and spectral complexity. These are physical attributes that can be measured and the loudness can be estimated from those using existing models [3,4,5].

Domestic multichannel sound systems, with or without pictures, are becoming increasingly popular. A sound system has to be calibrated to ensure the best possible aural environment. A traditional stereo system usually has two identical loudspeakers. When they are set-up symmetrically in a room and the listener stays with equal distance to both of them, the level calibration is quite simple. The system is provided with balance control, which can be set to middle; equal gains to both channels. If the listening position is closer to one of the loudspeakers or the loudspeakers are set-up asymmetrically to the room, the balance must be re-adjusted. This provides the listener with a means of level control.

The current trend in the field of domestic sound system is towards multichannel systems having more that two loudspeakers, like the 5 channel system shown in FIG. 1*a*. With multichannel system the calibration situation can be far more complex than with traditional stereo system. The loudspeakers often have different characteristics; they differ in bandwidth, sensitivity, directivity etc. Furthermore the positioning of a loudspeaker has a great effect on room coupling. The loudspeaker in a corner of the room or just close to one wall may have very different amplitude response characteristics than one located away from the walls.

In the ideal situation such as specified in e.g. ITU-R BS.775-1, shown in FIG. 1*a*, the central loudspeaker 102, the left and right loudspeakers 104*a* and 103*a* as well as left and right surround loudspeakers 105*a* and 106*a* have an equal distance to the listening position 101. In FIG. 1*b* a more realistic loudspeaker placement is shown. The loudspeakers 102, 103*a*, 104*a*, 105*a*, 106*a* are normally placed near the walls. When the shape of the room 110*b* is not ideal from the viewpoint of aural environment, it is typical that the distances from the loudspeakers 102, 103a, 104*a*, 105*a*, 106*a* to the listening location 101 are not equal. With these circumstances even matching the reproduction level of centre channel from the loudspeaker 102 to usually identical left and right channels from the loudspeakers 104*a* and 103*a* is difficult. And further the situation with surround channels from loudspeakers 106*a* and 105*a* is even more problematic. The situation becomes even more problematic when the room coupling effects are taken into account. These problems relate to bandwidth, sensitivity, directivity, and distances of the loudspeakers and room interaction.

The object of the sound system calibration is to calibrate the loudspeakers 102, 103*a*, 104*a*, 105*a* and 106*a* so that in the listening position 101 it seems, or rather sounds, like the sound is coming from the virtual loudspeakers 103*b*, 104*b*, 105*b* and 106*b*, all at equal distances from a listening position 101. This sensation of virtual loudspeakers is achieved mainly by the two methods. First, by changing delay times of each loudspeaker 102, 103*a*, 104*a*, 105*a*, 106*a* so that sound meant to be heard simultaneously are transmitted at different times by each loudspeaker so that the sounds arrive to the listening position 101 simultaneously. Secondly, by adjusting the gain of each loudspeaker so that they produce equal loudness at the listening position 101.

There are basically two methods for calibrating a multichannel sound system. The calibration can either be done automatically without human perception or subjectively when the person calibrating the system calibrates the system according his personal subjective audio perceptions.

An automatic calibration is quite an accurate method for calibrating delay times for each loudspeaker, but not as good for loudness calibration. The loudness is a auditory sensation, and as such it cannot be directly measured in the same manner as acoustic pressure or intensity, which are physical attributes and as such straightforward to measure. Therefore a subjective calibration is mainly used for loudness calibration. So called "pink noise" [1] is most often used as a test signal in subjective calibration, because its spectrum correlates well to statistical properties of natural sound. Bandlimited test sounds are normally used in subjective loudness calibration, to avoid problems with room coupling on lower frequencies and location sensitivity with the higher frequencies.

In FIG. 2 a flow chart of the prior art method 200 for automatic sound system calibration is shown. In step 201 a test signal is generated. The test signal is preferably some pseudorandom signal allowing the calculation of the periodic impulse response of the aural environment under study. Said aural environmental includes the actual multichannel sound system as well as loudspeakers and the listening space as they give a considerable contribution to the aural environment. One possible test signal type is a maximum-length sequence (MLS) [2].

In the step 202 the test signal is transmitted via a sound source i.e. loudspeaker to the listening space. In the step 203 the test signal is received by a microphone at the preferred listening position.

In step 204 a cross correlation between the original signal generated in step 201 and the signal received in step 203 is carried out. If the test signal is an MLS or similar signal, this gives in step 205 the periodic impulse response of the aural environmental. In step 207 various parameters giving information about aural properties the aural environment in the time domain, like arrival times, early reflection and room reverberation information are calculated from the periodic impulse response.

In step 206 the periodic impulse response of the system is transformed to the frequency domain using a fast fourier transform (FFT) algorithm. In step 208 various frequency domain properties of the aural environment, like phase and amplitude response, are calculated from FFT transform of the periodic impulse response.

In step 209 an automatic calibration is carried out according to the time and frequency domain information calculated in steps 207 and 208. By applying similar calibration for each sound source, the whole system can be calibrated.

The problem of the above stated prior art is that with automatic calibration the achieved calibration is not sufficiently good due the subjective nature of the loudness. The calibration according only to physical terms does not necessarily provide optimum calibration in perceptual terms. On the other hand, when using subjective loudness calibration the test signals do not excite the room or the listener to the extent the programme material does. In addition some frequency ranges are more dominant at the perceptual level, thus making the calibration based on only to these ranges. Therefore the calibration according to the prior art does not give sufficiently accurate calibration causing the spatial attributes produced by the system to be different from the intentions of the programme maker.

In the prior art different test signals are used in automated and subjective calibration, thus making the calibration procedure and systems unnecessary complex.

SUMMARY OF THE INVENTION

An object of the present invention is to provide a new method and a new multichannel sound system for carrying out the loudness calibration, so that accurate subjective calibration can be achieved on a wider frequency range compared to the prior art, thus making the loudness calibration of the multichannel sound system more accurate.

Further the object of the present invention is to provide a new method and a new multichannel sound system for carrying out both subjective and objective calibration using the same test signal in both calibrations. Therefore the calibration phase of the sound system can be simplified.

The above stated objects are achieved by psychoacoustically shaping the test signal. The psychoacoustically shaped test signal preferably is a pseudorandom test signal suitable for both automatic and subjective loudness calibration. Further the psychoacoustically shaped test signal has preferably essentially constant specific loudness on the frequency range essential for aural perception.

Compared to the prior art, the present invention gives significant advantages. Using the method and the system according the invention one can achieve more accurate loudness calibration using simpler and easier procedures compared to the prior art.

BRIEF DESCRIPTION OF THE DRAWINGS

The present invention will now be described more in detail in the following with the reference to the accompanying drawing, in which

FIGS. 1 and 2 have been discussed above in context of the prior art.

DETAILED DESCRIPTION OF THE PREFERRED EMBODIMENTS

Several acoustic models for estimating the loudness from e.g. one-third-octave band levels of the sound have been developed [3,4, and 5]. They model the sound transmission through outer ear, middle ear as well as the excitation on the basilar membrane in inner ear. These models also include a modelling of psychological aspect of audio perception. As the models include both psychological and acoustic properties of the aural perception, the models are called psychoacoustic models. Using these models it is possible to plot loudness as a function of frequency, i.e. so called specific loudness.

Figure 3:
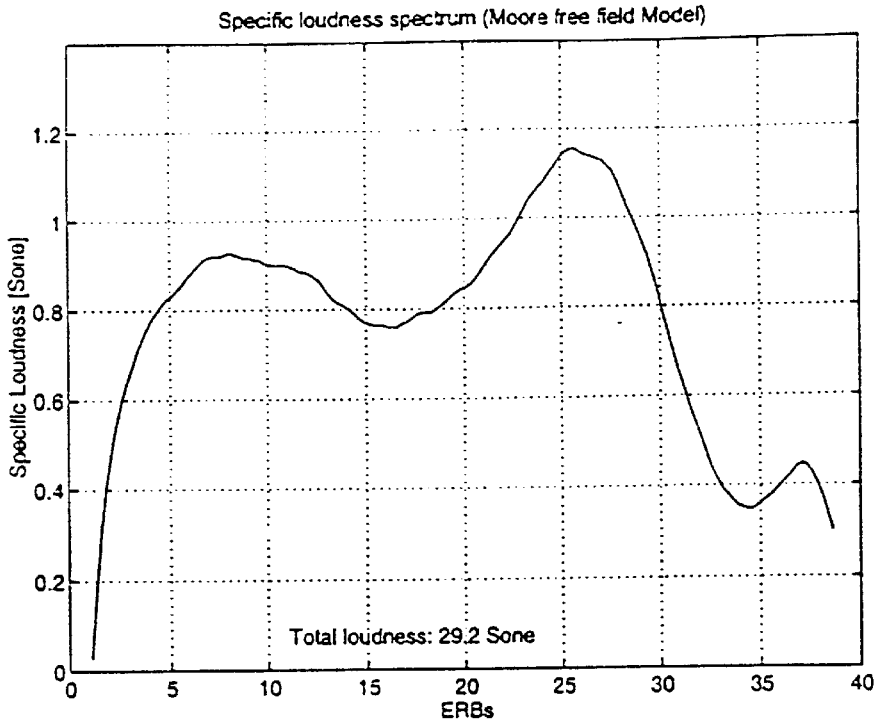
FIG. 3 shows specific loudness of a pink noise signal.

In FIG. 3 a specific loudness spectrum of a pink noise signal plotted as a function of frequency obtained by using a Moore free field model presented in reference [3] is shown. The frequency is expressed in Equivalent Rectangular Bandwidth (ERB) scale. This is a perceptual frequency scale, based on critical bandwidths [3,5]. Lower (fl), centre (fc) and upper corner (fu) frequencies in Hz and bandwidths (Δf) in Hz of ERB-bands are shown in the following table.

| ERB | fl | fc | fu | Δf |
|---|---|---|---|---|
| 1 | 13 | 26 | 40 | 27 |
| 2 | 40 | 55 | 71 | 31 |
| 3 | 71 | 87 | 105 | 34 |
| 4 | 105 | 123 | 143 | 38 |
| 5 | 143 | 163 | 185 | 42 |
| 6 | 185 | 208 | 232 | 47 |
| 7 | 232 | 258 | 285 | 52 |
| 8 | 285 | 313 | 343 | 58 |
| 9 | 343 | 375 | 408 | 65 |
| 10 | 408 | 444 | 481 | 73 |
| 11 | 481 | 520 | 562 | 81 |
| 12 | 562 | 605 | 652 | 90 |
| 13 | 652 | 700 | 752 | 100 |
| 14 | 752 | 806 | 863 | 112 |
| 15 | 863 | 924 | 988 | 124 |
| 16 | 988 | 1055 | 1126 | 138 |
| 17 | 1126 | 1201 | 1280 | 154 |
| 18 | 1280 | 1364 | 1452 | 172 |
| 19 | 1452 | 1545 | 1643 | 191 |
| 20 | 1643 | 1747 | 1857 | 213 |
| 21 | 1857 | 1972 | 2094 | 237 |
| 22 | 2094 | 2222 | 2358 | 264 |
| 23 | 2358 | 2501 | 2653 | 294 |
| 24 | 2653 | 2812 | 2980 | 328 |
| 25 | 2980 | 3158 | 3346 | 365 |
| 26 | 3346 | 3544 | 3752 | 407 |
| 27 | 3752 | 3973 | 4205 | 453 |
| 28 | 4205 | 4451 | 4710 | 505 |
| 29 | 4710 | 4984 | 5272 | 562 |
| 30 | 5272 | 5577 | 5898 | 626 |
| 31 | 5898 | 6237 | 6595 | 697 |
| 32 | 6595 | 6973 | 7372 | 777 |
| 33 | 7372 | 7793 | 8237 | 865 |
| 34 | 8237 | 8705 | 9200 | 963 |
| 35 | 9200 | 9722 | 10273 | 1073 |
| 36 | 10273 | 10854 | 11468 | 1195 |
| 37 | 11468 | 12116 | 12799 | 1331 |
| 38 | 12799 | 13520 | 14282 | 1482 |
| 39 | 14282 | 15085 | 15933 | 1651 |
| 40 | 15933 | 16828 | 17772 | 1839 |
| 41 | 17772 | 18769 | 19820 | 2048 |
| 42 | 19820 | 20930 | 22102 | 2281 |

In a FIG. 3 one can observe a clear peak in the loudness spectrum having centre at ERB-band 26. This would suggest that a person listening to a pink noise signal actually hears frequencies between 2 and 6 kHz louder than the lower and higher frequencies. Therefore when a pink noise is used as a test signal for subjective loudness calibration, the resulting adjustment will become based mainly on this relatively narrow band.

If the specific loudness is constant throughout the whole frequency range, all frequency components would be heard equally loud. With this kind of a test signal the person who does the level calibration subjectively can effectively use the whole frequency range for calibration. As each person has an individual aural perception or a so called head related transfer function (HRTF), an optimum calibration signal can be generated for each person for calibrating the system to suit his individual needs. A HRTF function basically describes how the shape of a human head affects the observed sound signal.

The above mentioned signal having constant specific loudness can be generated by using a psychoacoustic model to determine optimum signal shape and by shaping the test signal accordingly to provide uniform, frequency independent simulation at a constant loudness level. This shaping can be done by using an optimisation routine to find a shaping function giving the desired target level. The target level is preferably based on the actual reproduction level, because the specific loudness is level dependent.

The specific loudness depends also on the angle of the incidence of the sound as determined by the HRTF's used. The HRTF's can be measured using a Head-and-Torso simulator (HATS) or with the help of actual persons and a chosen set of angles of incidence, as performed according to prior art. In the simplest case only one HRTF can be used, corresponding to the angle with respect to the center channel (0°). Using this we can get a single test signal shaping. Further, the HRTF's for the angles corresponding to channels can be utilized. These can be used for example to obtain three test signals to give angular constant specific loudness (ACSL). If the loudspeaker set-up is symmetric, only one half of the calibration plane is needed since HRTF functions are symmetric with respect to the median plane. Using a set of ACSL signals for subjective calibration, a listener would perceive the signals to differ only in terms of loudness, but to be the same in terms of timbre. This leads to a simpler subjective calibration task.

Figure 4:
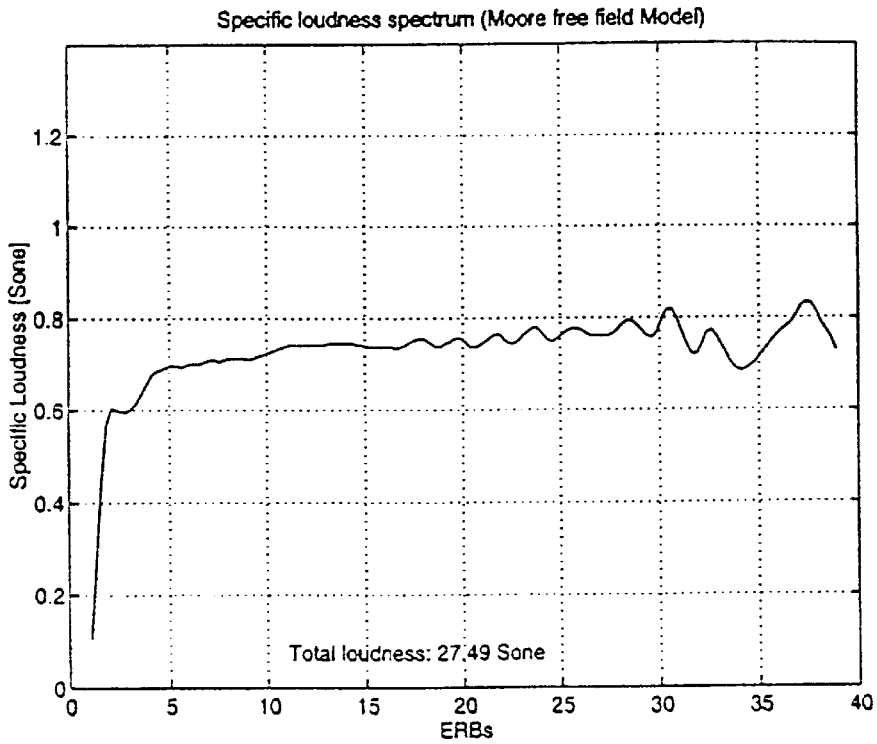
FIG. 4 shows specific loudness of a signal according the present invention.

In FIG. 4 a psychoacoustically shaped signal having an essentially constant specific loudness on the whole frequency range essential for audio perception is shown. When compared to specific loudness of a non-psychoacustically shaped pink noise signal shown in FIG. 3 it is clear that a person hearing a psychoacoustically shaped test signal having a constant specific loudness over a wide frequency range can achieve more accurate loudness calibration on a wider frequency range than a person using a pink noise signal.

Figure 5:
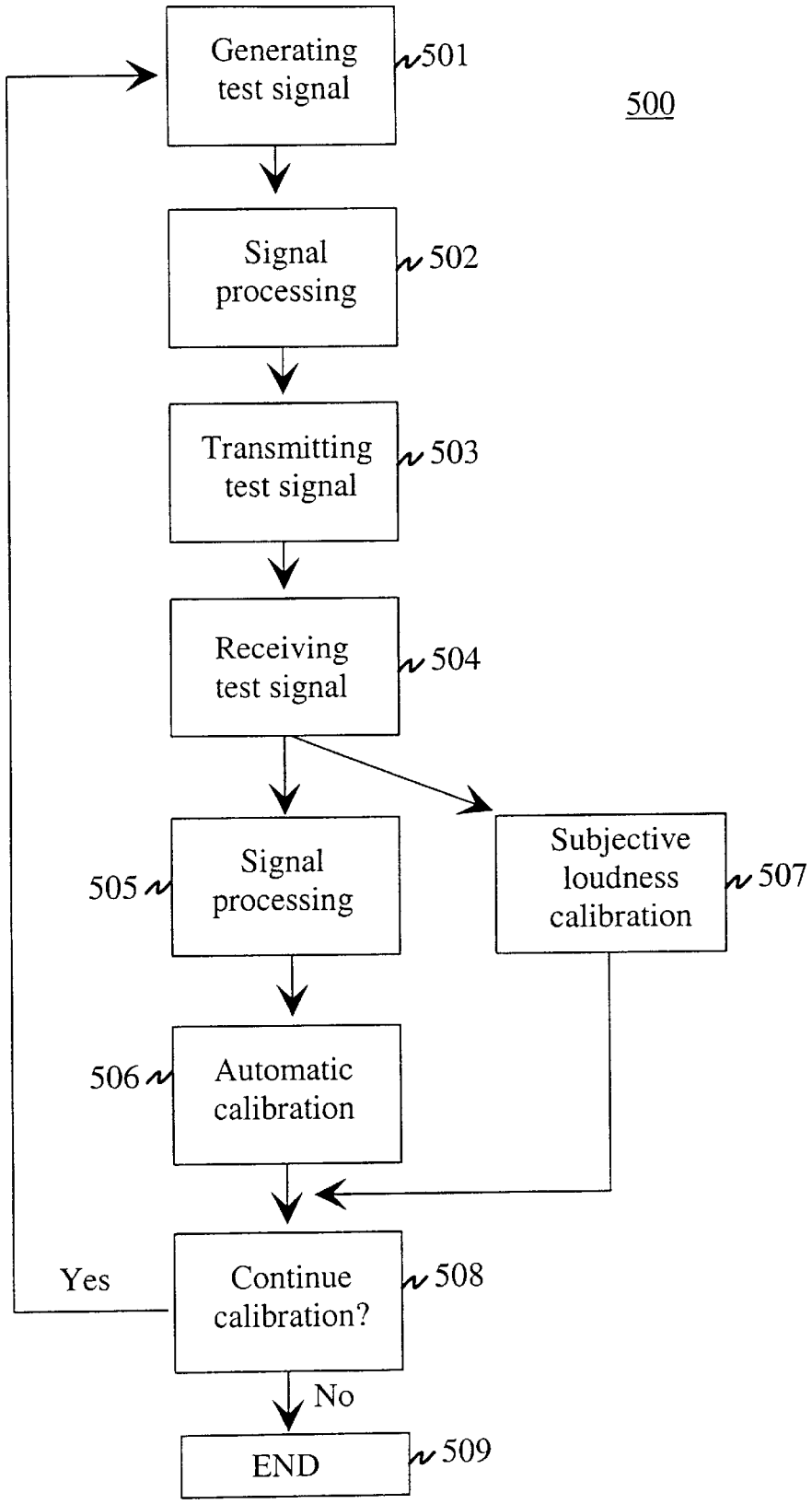
FIG. 5 shows a flow chart of an embodiment of a method for loudness calibration according the present invention.

In FIG. 5 a flow chart of a method for loudness calibration of a multichannel sound system according the present invention is presented. First in step 501 a test signal is generated. This test signal is preferably suitable for automatic calibration purposes. This signal can be for an MLS signal or any other pseudorandom noise signal maintaining its properties when it is filtered using linear filtering to get coloured noise. Pseudo random noise is deterministic, so it can be easily generated and repeated exactly.

If the test signal used is suitable for automatic calibration, then the both automatic and subjective loudness calibration can be carried out using the same signal. This simplifies the calibration procedure compared to the prior art where two different signals have to be used. The test signal can reside in read-only-memory (ROM) or it can be generated during the calibration process. The most important properties of test signals for automatic calibration are that they have a sufficiently long period and that the ratio of one existing maximum and the mean of the autocorrelation is high.

In step 502 psychoacoustical shaping of the test signal is carried out. As the degree of shaping can be varied according the level of sophistication of the sound system various signal processing methods can be used in signal shaping. In the most basic system steps 501 and 502 can be combined to one step, where a psychoacoustic test signal is generated directly, not by shaping a previously generated test signal. This simplifies the signal generation procedure, but limits the versatility of the signal processing. In more advanced systems signal processing in step 502 could include individual shaping of a test signal for each person calibrating the system. In such a system various personal differences like hard of hearing in certain frequency ranges could be taken into account, thus given optimum aural environmental to persons having non-average audio perception.

Figure 1A:
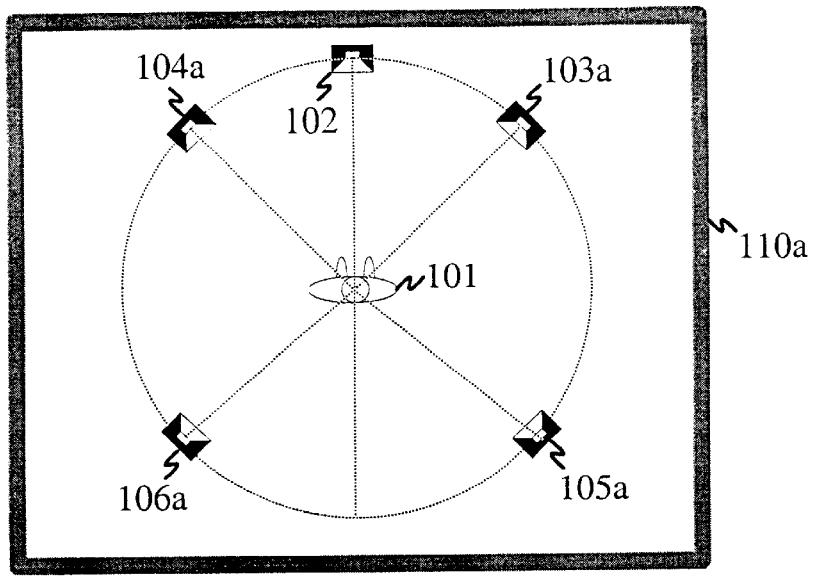
Fig. 1a PRIOR ART
FIG. 1 shows an ideal and a non-ideal layout of a 5 channel sound system.
Figure 1B:
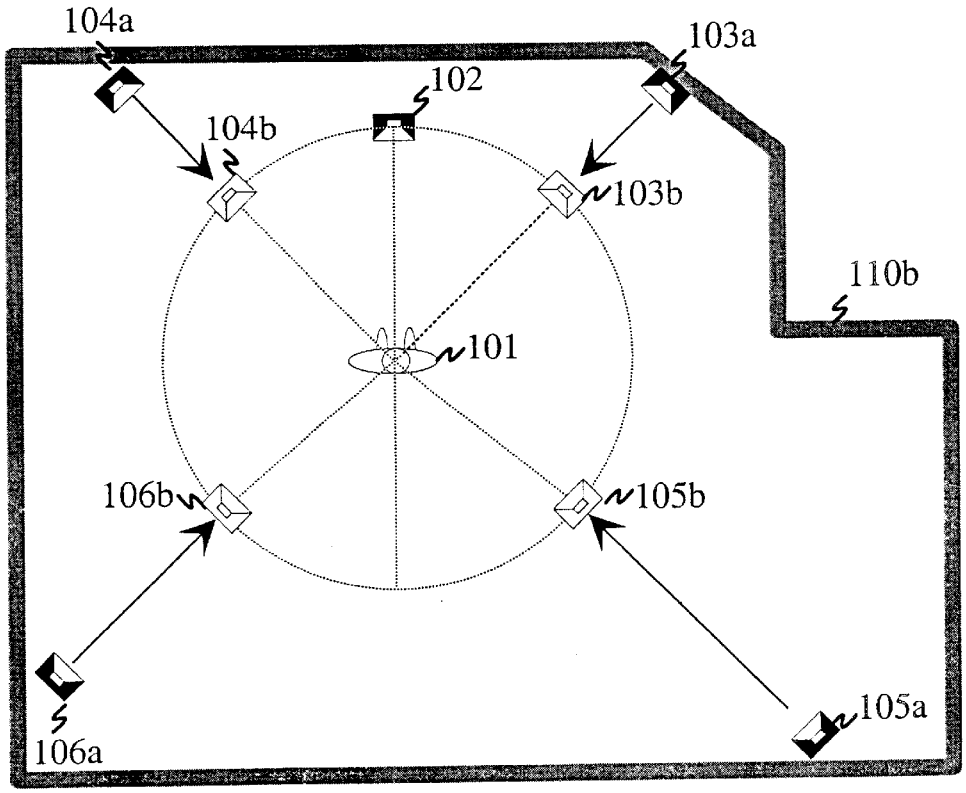
Fig. 1b PRIOR ART
Figure 2:
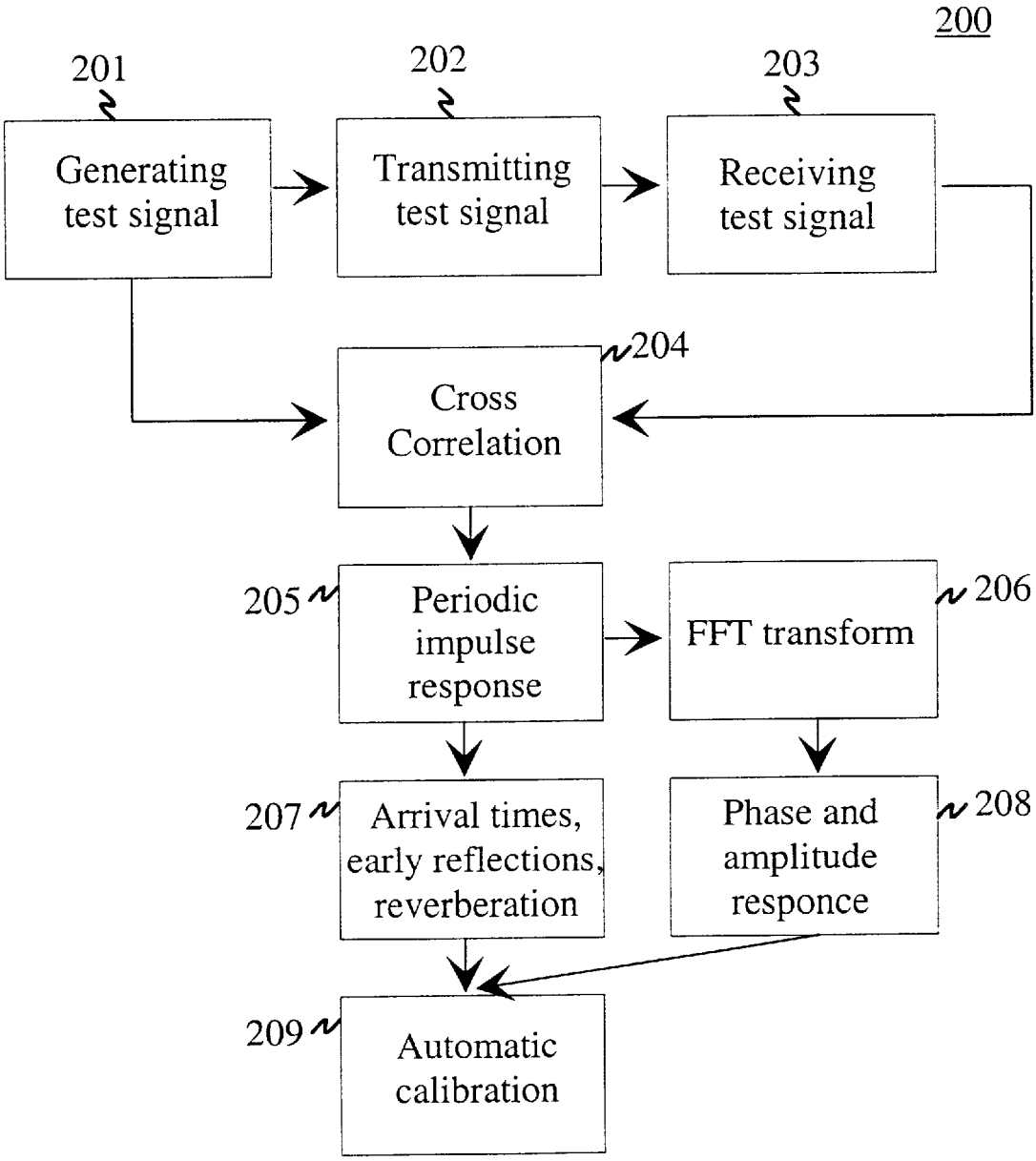
Fig. 2 PRIOR ART
FIG. 2 shows a flow chart of an embodiment of a method for automatic loudness calibration according the prior art.

Because of the outer ear, the specific loudness depends on the angle of the sound source with respect to the listener. The room coupling also has effect on the loudness perceived in the listening position. These parameters depend on the location of each loudspeaker with respect to the listening position and can be taken into account by individually shaping the test signal for each loudspeaker. The difference of binaural specific loudness between frontal channels is relatively small, when the loudspeakers 103*a* and 104*a* in FIGS. 1*a* and 1*b* are relatively close to one another. Therefore the same shaping provides closely the same perception from centre loudspeaker 102 and left and right loudspeakers 103*a* and 104*a*. For surround loudspeakers 105*a* and 106*a* the difference is greater and it is possible to create another shaping for those. A psychoacoustic model can be used to estimate the difference on the loudness from different loudspeakers. When the loudness difference is known it can be compensated by adjusting the gain of the appropriate loudspeaker.

In step 503 the psychoacoustically shaped test signal is transmitted via a loudspeaker to the listening space. To keep the calibration procedure simple it is preferred that the test signal is transmitted to only one loudspeaker at a time. This way each loudspeaker can be individually calibrated without sounds from the other loudspeakers interfering.

In step 504 the test signal is received either by an audio sensor or by a person listening to the test signal typically in the presumed listening position. The signal received by the audio sensor is then in step 505 subjected for signal processing that can be similar to those mentioned in the context of the prior art. After the signal processing the automatic calibration for the current loudspeaker is carried out in step 506.

If the subjective loudness calibration is carried out then the person listening to the test signal in step 504 can carry out the subjective calibration in step 507 right after step 504 as there is no need for signal processing.

When the current calibration loop is carried out, then in step 508 it is determined if another calibration loop is needed. New loop is needed for example if one wants to check the calibration made in the previous steps 507 or 506, or if any loudspeaker is yet without calibration. One preferred method to carry out the calibration is to first carry out the automatic calibration and after to carry out the subjective calibration. This way the coarse loudness calibration is carried out by automatic calibration leaving only the fine calibration, where the subjective effect is dominant to the person calibrating the system.

If a new loop is needed, then the method loops back to step 501 for generation of the next test signal. If all loudspeakers and thus the whole system has been calibrated then the calibration ends in step 509.

Figure 6:
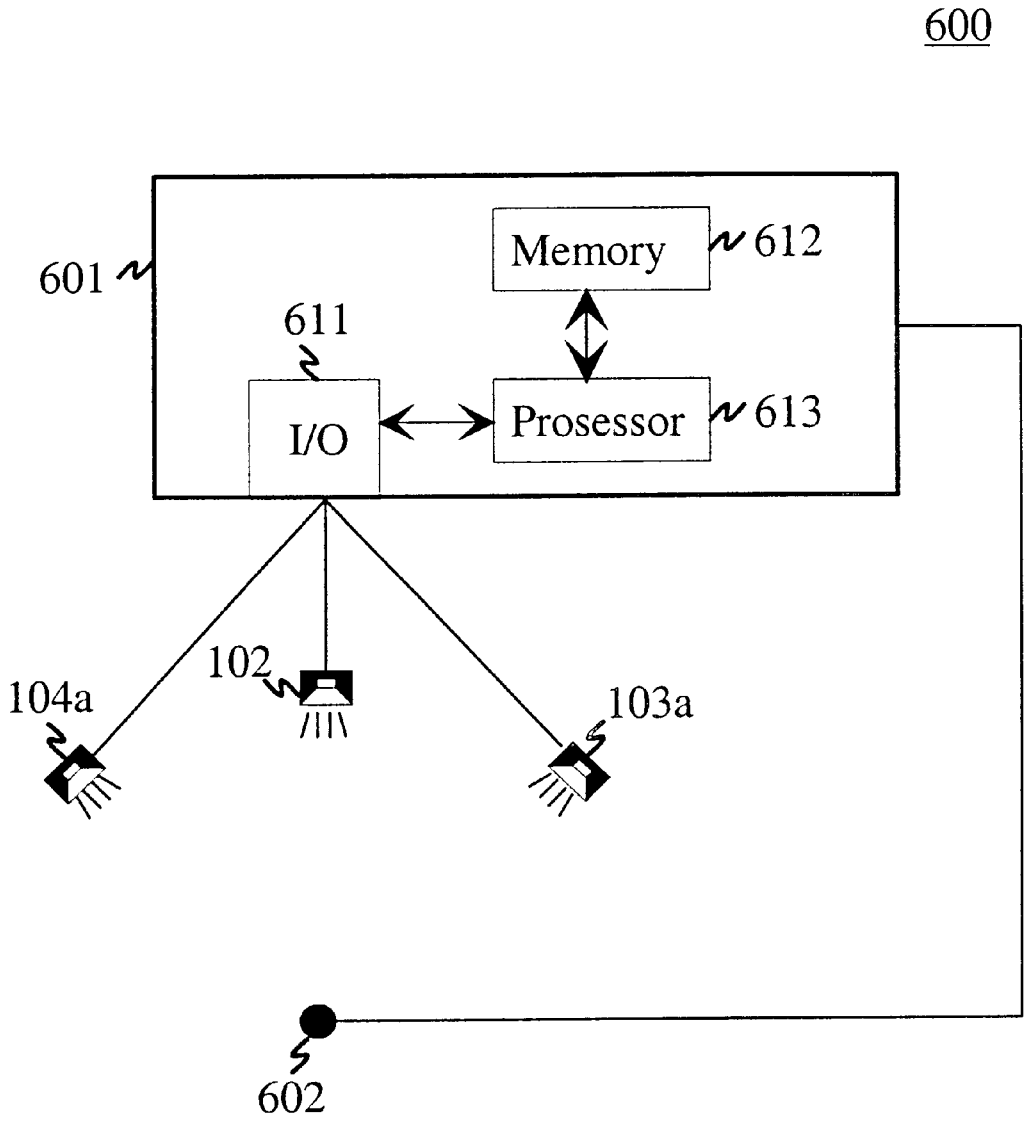
FIG. 6 shows schematically a system according the present invention for loudness calibration.

In FIG. 6 a sound system 600 according the present invention is shown. The system 600 has a main unit 601 comprising an I/O-unit 611, a processor 613 and a memory 612. Three loudspeakers 102, 104*a* and 103*a* are connected to the I/O-unit of the main unit 601. A feedback device 602 is connected to the main unit 601 for relaying calibration information.

The processor 613 generates a psychoacustically shaped test signal according a program stored in the memory 612. The psychoacoustic test signal can either be generated as such or it can shaped from another signal as previously stated. The generated psychoacoustic test signal is directed via the I/O-unit 611 to the appropriate loudspeaker 102; 103*a* or 104*a*.

The feedback means 602 are typically placed in the presumed listening position. If an automatic calibration is used then the feedback means 602 must have an audio sensor capable of receiving the test signal. The feedback means 602 could also comprise some means to calculate the calibration instructions from the received signal and means for relaying this information to the main unit 601. Another possibility is that the received signal is transferred as such to the main unit 601, where the received signal is analysed and appropriate adjustments made by the processor 613.

In subjective calibration the feedback means 602 have means for relaying information inputted by the person calibrating the system to the main unit 601. In a simple case the feedback means 602 could be a potentiometer for changing the gain of the current channel. The actual method for receiving the aural information and relaying it back to the main unit 601 is not essential to the present invention, but can be accomplished in any of numerous ways obvious to the man skilled in the art.

The inventive method can be used for loudness calibration for sound systems with more than one discrete or virtual channel. Further, the inventive method can be used for calibration of so called 3-D sound systems as well, one example of which is described in reference [6]. Further, the inventive method has the advantage, that it can be used to calibrate a wide variety of systems from relatively simple and low-priced low end consumer products to complicated, high-quality high end products. For example, to utilize the inventive method in a low end product, the test signal may be stored in a memory device such as a ROM memory, and be used for subjective calibration. To obtain more advanced consumer products, the inventive method can comprise automatic level calibration, and/or be combined with one or more of the following techniques: automated time alignment and equalization.

In view of the foregoing description it will be evident to a person skilled in the art that various modifications may be made within the scope of the invention. While a preferred embodiment of the invention has been described in detail, it should be apparent that many modifications and variations thereto are possible, all of which fall within the true spirit and scope of the invention. Specifically the present invention is not limited to the use of the particular example of a psychoacoustic method described previously for shaping the test signal.

REFERENCES:

[1] Moore B. C. J, "An Introduction to the Psychology of Hearing", Academic Press, 1997.

[2] Douglas D. Rife, John Vanderkooy, "Transfer-Function Measurement with Maximum-Length Sequences", Journal of Audio Engineering Society, Vol. 37, No. 6, 1989 June

[3] Moore B. C. J., Glasberg B. R., "A revision of Zwicker's Loudness Model", Acustica, Vol.82, pp. 335–45, 1996.

[4] Paulus E., Zwicker E., "Programme zur automatischen Bestimmung der Lautheit aus Terzpegeln oder Frequenzgruppenpegeln", Acustica, Vol. 27. pp. 253–266, 1972.

[5] Moore B. C. J., Glasberg B. R., and Baer T., "A model for prediction of thresholds, loudness, and partial loudness Model", J. Audio Eng. Soc., Vol. 45, pp. 224–239, 1997.

[6] Begault, "3-D Sound for Virtual Reality and Multimedia", AP Professional, 1994.

What is claimed is:

1. A method for loudness calibration of a multichannel sound system having at least two sound sources each for providing a different channel of the multichannel sound system, comprising steps of a) generating a test signal for each of the two sound sources, b) transmitting the test signals from the two sound sources, c) receiving the test signals at a listening position, d) calibrating loudness using the received test signals, wherein in the step of generating the test signals, psychoacoustically shaped test signals are generated, and wherein the test signals each have an essentially constant specific loudness on at least substantially the whole frequency range necessary for audio perception.

2. The method according to claim 1, wherein said test signals are pseudorandom signals.

3. The method according to claim 2, wherein at least one of said test signals is a Maximum-Length Sequence (MLS) type signal.

4. The method according to claim 1, wherein the step of generating the psychoacoustically shaped test signals comprises generating individual psychoacoustically shaped test signals for each of the two sound sources.

5. The method according to claim 4, wherein said test signals are generated for different sound sources according to the location of the sound source with respect to the listening location.

6. The method according to claim 1, wherein the step of generating the psychoacoustically shaped test signals comprises generating individual psychoacoustically shaped test signals for each person carrying out the calibration of the system.

7. The method according to claim 1, wherein the step of calibrating loudness comprises carrying out both automatic loudness calibration and manual loudness calibration using the same psychoacoustically shaped test signals.

8. A multichannel sound system comprising:

at least two sound sources, each for providing a different channel of the multichannel sound system, means for generating a test signal for each of the two sound sources of the multichannel sound system, and means for carrying out loudness calibration according to the test signals transmitted by each of the two sound sources, wherein the means for generating the test signals generates a psychoacoustically shaped test signal.

9. The system according to claim 8, the means for generating a test signal generates a psychoacoustically shaped test signal for automatic loudness calibration.

10. The system according to claim 8, wherein the means for generating a test signal generates a pseudorandom psychoacoustically shaped test signal.

11. The system according to claim 10, wherein the means for generating a test signal generates a Maximum-Length sequence (MLS) type signal.

12. The system according to claim 8, wherein the means for generating a test signal comprises means for generating individually shaped test signals for different sound sources.

13. The system according to claim 12, wherein the means for generating a test signal comprises means for shaping individual test signals for different sound sources according to the location of the sound source in respect to the listening location.

14. The system according to claim 10, wherein the means for generating a test signal generates an individual psychoacoustically shaped test signal for each person calibrating the system.

15. The system according to claim 8, wherein the means for carrying out loudness calibration comprises means for carrying out manual loudness calibration.

16. A method for loudness calibration of a multichannel sound system, comprising steps of a) generating a test signal, b) transmitting the test signal from at least one sound source, c) receiving the test signal preferably at the presumed listening position, d) calibrating loudness using the received test signal, wherein in the step of generating a test signal, a psychoacoustically shaped test signal is generated, and wherein the test signal has an essentially constant specific loudness on at least substantially the whole frequency range necessary for audio perception, and wherein the test signal is a pseudorandom Maximum-Length Sequence (MLS) type signal.

17. A multichannel sound system having at least means for generating a test signal, at least two sound sources, and means for carrying out loudness calibration according to the test signal transmitted by at least one sound source, wherein the means for generating a test signal generates a pseudorandom psychoacoustically shaped test signal, wherein the means for generating a test signal generates a pseudorandom psychoacoustically shaped Maximum-Length Sequence (MLS) type test signal.

* * * * *

UNITED STATES PATENT AND TRADEMARK OFFICE

CERTIFICATE OF CORRECTION

PATENT NO. : 6,639,989 B1 
APPLICATION NO. : 09/400770
DATED : October 28, 2003
INVENTOR(S) : Nick Zacharov, Pekka Suokuisma and Soren Bech It is certified that error appears in the above-identified patent and that said Letters Patent is hereby corrected as shown below:

On the title page item (54), and Col. 1, line 2, "METHOD FOR LOUDNESS CALIBRATION OF A MULTICHANNEL SOUND SYSTEMS AND A MULTICHANNEL SOUND SYSTEM" should be --METHOD FOR LOUDNESS CALIBRATION OF A MULTICHANNEL SOUND SYSTEM AND A MULTICHANNEL SOUND SYSTEM--.

Front page: "Inventors: Nick Zacharov, Tampere (FI); Pekka Suokuisma, Korkeakoski (FI)" should be --Inventors: Nick Zacharov, Tampere (FI); Pekka Suokuisma, Korkeakoski (FI); Soren Bech, Holstebro (DN)--.

Column 8, line 62, claim 9, "the system according to claim 8, the means" should be --the system according to claim 8, wherein the means--.

Column 9, line 12, claim 14, "the system according to claim 10, wherein" should be --the system according to claim 8, wherein--.

Signed and Sealed this

Third Day of October, 2006

JON W. DUDAS
*Director of the United States Patent and Trademark Office*